US006829827B2

(12) United States Patent
Tseng

(10) Patent No.: US 6,829,827 B2
(45) Date of Patent: Dec. 14, 2004

(54) ARTISTIC KNIFE WITH SPARE BLADES

(76) Inventor: Han Chung Tseng, P.O. Box 2103, Taichung (TW)

( * ) Notice: Subject to any disclaimer, the term of this patent is extended or adjusted under 35 U.S.C. 154(b) by 153 days.

(21) Appl. No.: 09/921,573

(22) Filed: Aug. 6, 2001

(65) Prior Publication Data

US 2003/0024124 A1 Feb. 6, 2003

(51) Int. Cl.[7] ..... B26B 1/08

(52) U.S. Cl. ..... 30/162; 30/124; 30/125; 30/335; 30/336

(58) Field of Search ..... 30/162, 124, 125, 30/335, 336

(56) References Cited

U.S. PATENT DOCUMENTS 3,872,591 A * 3/1975 Quenot ..... 30/162
5,203,085 A * 4/1993 Berns ..... 30/162
5,495,670 A * 3/1996 Quinn ..... 30/162
5,581,890 A * 12/1996 Schmidt ..... 30/162
5,613,300 A * 3/1997 Schmidt ..... 30/162
5,960,544 A * 10/1999 Beyers ..... 30/162
6,192,589 B1 * 2/2001 Martone et al. ..... 30/162
6,249,975 B1 * 6/2001 Lin ..... 30/162
6,327,780 B1 * 12/2001 Bigham et al. ..... 30/162
6,330,749 B1 * 12/2001 Khachatoorian et al. ..... 30/162
6,374,497 B1 * 4/2002 Sun ..... 30/162
6,415,514 B1 * 7/2002 Chun ..... 30/162
6,446,340 B1 * 9/2002 Ping ..... 30/162
6,513,246 B2 * 2/2003 Ping ..... 30/162
6,516,520 B1 * 2/2003 Liao ..... 30/162
6,553,674 B1 * 4/2003 Budrow ..... 30/162

* cited by examiner

*Primary Examiner*—Allan N. Shoap
*Assistant Examiner*—Jason Prone

(57) ABSTRACT

An artistic knife with spare blades, including a main body in which a blade seat is back and forth slidably disposed. The main body is formed with a receptacle corresponding to the blade seat for receiving multiple spare blades. Each blade has more than one engaging notch. The blade seat is provided with a transversely movable engaging block corresponding to the engaging notch of the blade for inserting therein. When the blade seat is slided forward, the blade is driven to extend out of the main body. The main body has a guide rail corresponding to the engaging block. By means of the guiding and restriction of the guide rail, in the travel of the blade pushed out by the blade seat, the engaging block is inserted into the engaging notches of the blade deeper and deeper. In returning travel, the depth by which the engaging block is inserted in the engaging notch is gradually reduced until it is slightly smaller than the thickness of the blade. Therefore, the engaging block can be truly engaged with the blade.

3 Claims, 13 Drawing Sheets

ARTISTIC KNIFE WITH SPARE BLADES

BACKGROUND OF THE INVENTION

The present invention is related to an improved artistic knife with spare blades. The main body of the artistic knife has a guide rail serving to guide and restrict an engaging block to truly engage with and drive the blade.

FIGS. 11 and 12 show a conventional artistic knife with spare blades. The artistic knife has a handle 8 one side of which is formed with a receptacle 81 for receiving blades 82 therein. Each blade 82 is formed with two notches 821 and two locating sections 811 are disposed in the receptacle 81 to restrict the blades 82. A blade seat 7 is disposed in the handle 8 corresponding to the receptacle 81. The upper edge of the blade seat 7 is punched with a resilient engaging plate 71. The engaging plate 71 slightly protrudes from the blade seat 7 and is engaged in the notches 821 of the blade 82 for fixing the innermost blade 82 in the receptacle 81. A push button 72 of the blade seat 7 serves to forward move the blade 82 to front end of the handle 8. In order to detach the blade 82, the handle 8 is provided with a press button 83 for pushing the resilient engaging plate 71 to disengage from the notches 821 of the blade. Under such circumstance, the blade 82 can be drawn out and replaced by a new one. A stop board 84 and a spring push section 83 are disposed at the receptacle 81 for pushing the blade 82 toward the blade seat 7.

Referring to FIG. 13, the resilient engaging plate 71 of the blade seat 7 slightly protrudes from inner edge of the blade seat 7. In order to effectively engage the engaging plate 71 into the notches 821 of the blade 82, the protrusion length T needs to be approximately equal to the thickness of the blade 82. However, the blade 82 has a quite thin thickness in which an error inevitably exists when manufactured. Therefore, the protrusion length T may be too small for the engaging plate 71 to effectively engage in the notches 821 of the blade 82. Accordingly, it is hard for the engaging plate 71 to drive the blade to extend out from the handle 8. On the other hand, the protrusion length T may be too long so that the engaging plate 71 may engage with two blades at the same time. Under such circumstance, the blades will block the front end of the handle 8 and cannot extend out.

SUMMARY OF THE INVENTION

It is therefore a primary object of the present invention to provide an improved artistic knife with spare blades in which a blade seat is back and forth slidably disposed in the main body of the knife. The main body is formed with a receptacle corresponding to the blade seat for receiving multiple spare blades. Each blade has more than one engaging notch. The blade seat is provided with a transversely movable engaging block corresponding to the engaging notch of the blade for inserting therein. The main body has a guide rail corresponding to the engaging block. By means of the guiding and restriction of the guide rail, in the travel of the blade pushed out by the blade seat, the engaging block is inserted into the engaging notches of the blade deeper and deeper. In returning travel, the depth by which the engaging block is inserted in the engaging notch is gradually reduced until it is slightly smaller than the thickness of the blade. Therefore, the engaging block can be truly engaged with one single blade.

It is a further object of the present invention to provide the above artistic knife in which the blade seat has a slot rearward extending from the blade cavity. In addition, the receptacle has a projecting block corresponding to the slot. The projecting block is inlaid in the slot for stopping the blade when the blade seat is moved backward. Accordingly, the blade is prevented from sliding backward along with the blade seat and getting out of the receptacle.

It is a further object of the present invention to provide the above artistic knife in which the handle is pivotally connected with rear end of the main body. The handle is formed with a chamber for receiving spare blades therein. Accordingly, the number of the spare blades is increased.

The present invention can be best understood through the following description and accompanying drawings wherein:

DETAILED DESCRIPTION OF THE PREFERRED EMBODIMENT

Figure 1:
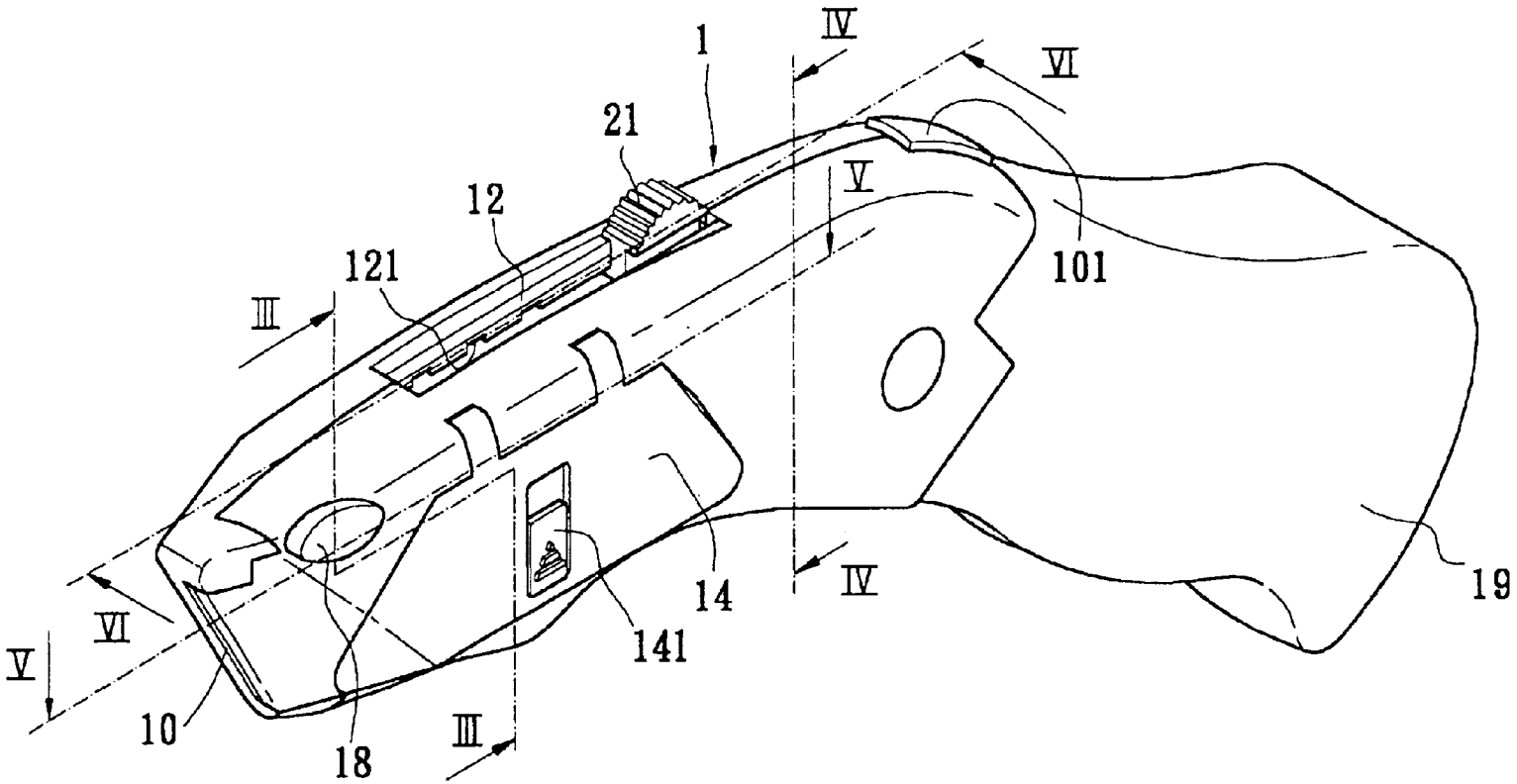
FIG. 1 is a perspective assembled view of the present invention.
Figure 2:
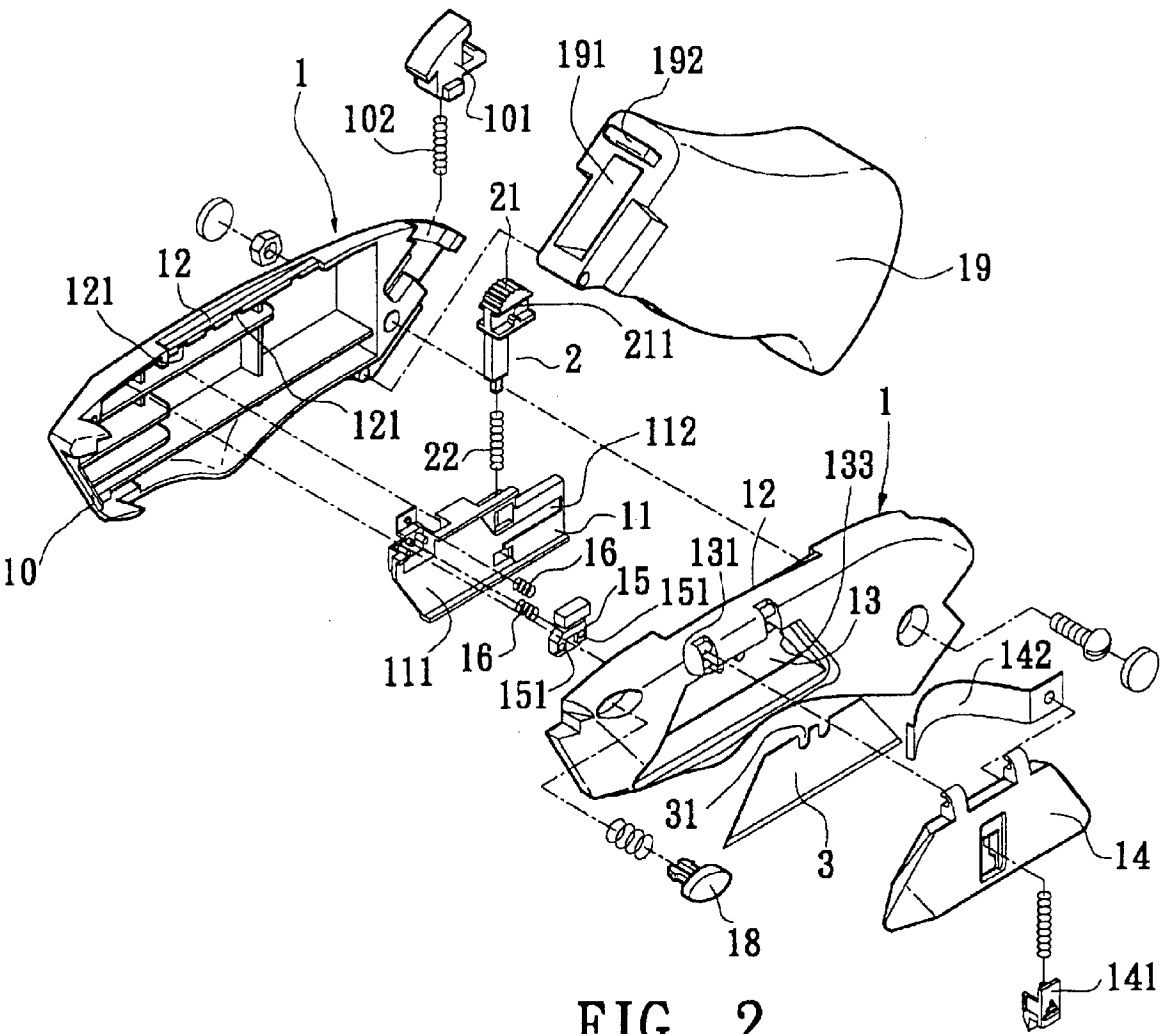
FIG. 2 is a perspective exploded view of the present invention.
Figure 4:
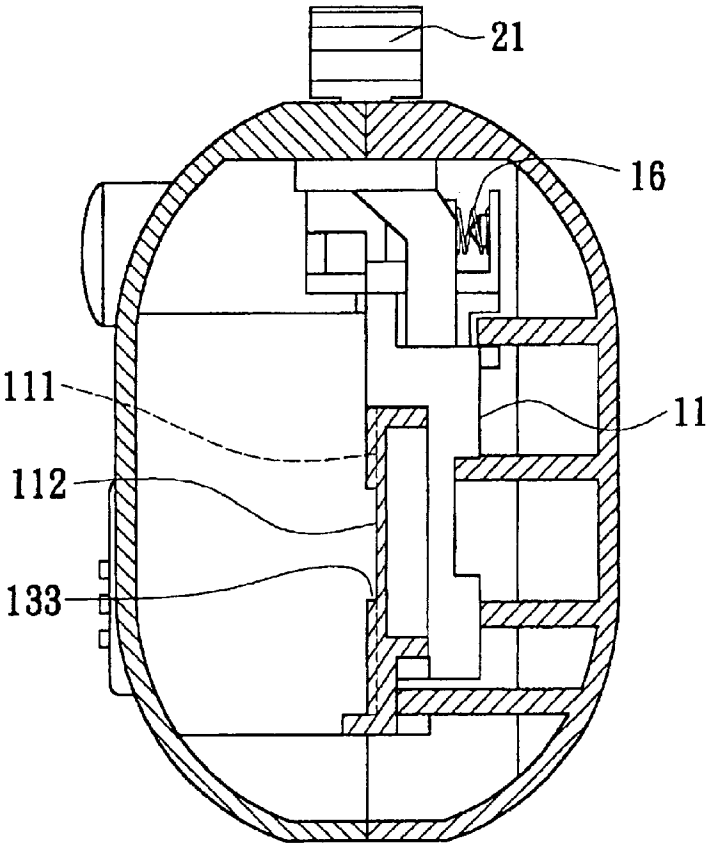
FIG. 4 is a sectional view taken along line IV—IV of FIG. 1.

Please refer to FIGS. 1 to 6. The artistic knife of the present invention includes a main body 1 in which a blade seat 11 is back and forth slidably disposed. The blade seat 11 is controlled by a push member 2 to move back and forth. The push member 2 is inserted in the blade seat 11 and is up and down movable relative to the blade seat 11. A push button 21 is disposed at the top end of the push member 2. A first spring 22 is positioned between the push button 21 and the blade seat 11 for resiliently pushing the push member 2 upward. The top of the main body 1 is formed with a slot 12 corresponding to the push button 21 for the push button 21 to slidably insert therein. The bottom edges of two sides of the slot 12 are formed with multiple engaging recesses 121 at intervals. Two sides of the push button 21 are formed with projections 211 for engaging in the engaging recesses 121 to locate the blade seat 11.

The main body 1 is formed with a receptacle 13 corresponding to the blade seat 11 for receiving multiple blades 3. Each blade 3 has two engaging notches 31 formed side by side. The receptacle 13 is formed with two locating sections 131 corresponding to the engaging notches 31 for restricting the blades 3 from moving back and forth. One side of the receptacle 13 has an opening 132 passing through the main body 1 opposite to the blade seat 11. A cover 14 is pivotally disposed at the opening 132. The cover 14 has a latch 141 for locking the cover 14 on the opening 132. In addition, the cover 14 has an inward projecting resilient member 142 for resiliently pushing the blades 3 to abut against the blade seat 11.

The blade seat 11 is formed with a blade cavity 111 corresponding to the blade 3 in the receptacle 13. The blade cavity 111 has a depth slightly shorter than the thickness A of the blade 3. The blade cavity 111 has a rearward extending slot 112. The receptacle 13 has a projecting block 133 corresponding to the slot 112. The projecting block 133 is inlaid in the slot 112 for stopping the blade 3 from sliding backward along with the blade seat 11.

Figure 3:
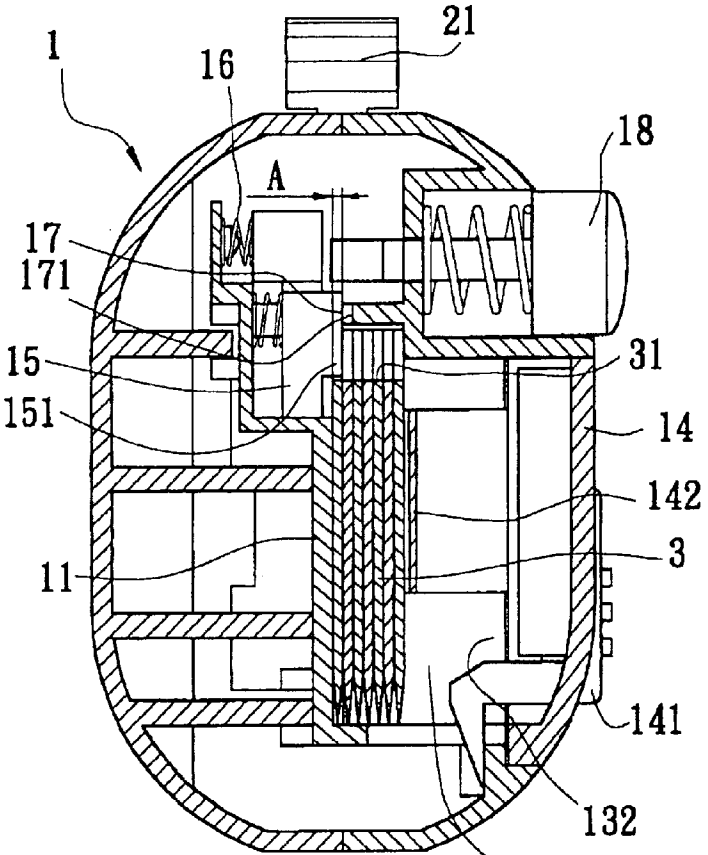
FIG. 3 is a sectional view taken along line III—III of FIG. 1.
Figure 5:
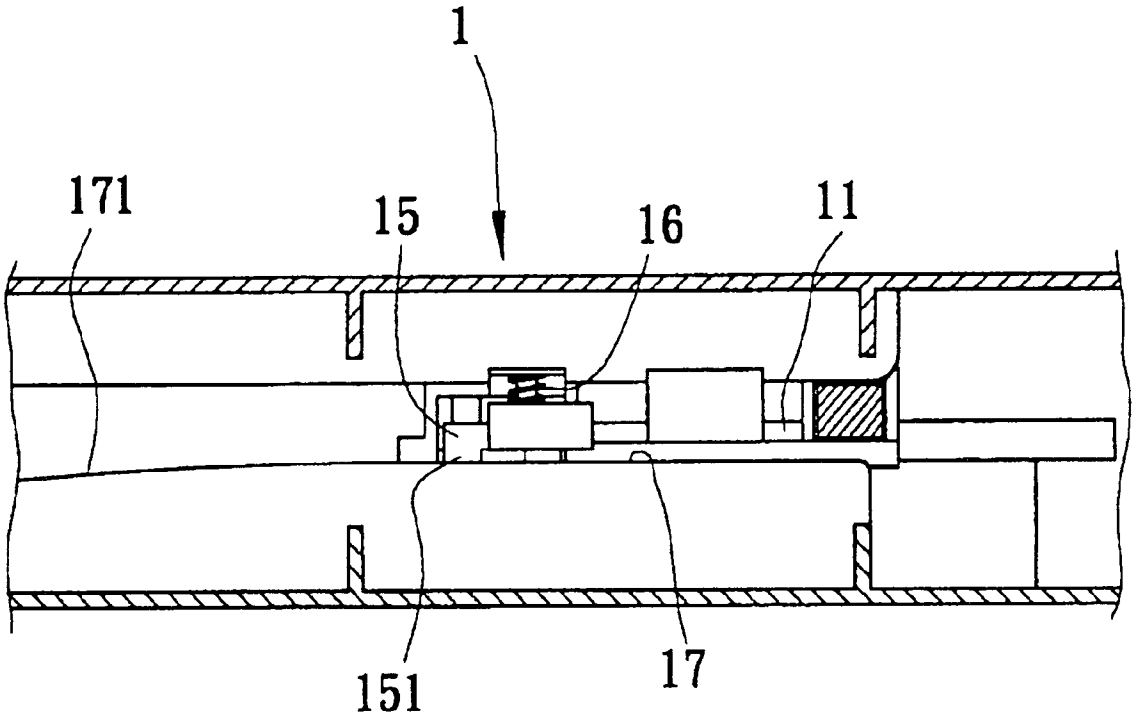
FIG. 5 is a sectional view taken along line V—V of FIG. 1.

The blade seat 11 is provided with a transversely movable engaging block 15 disposed at a position corresponding to the two engaging notches 31 of the blade 3. The engaging block 15 has two projecting sections 151 for respectively engaging with the engaging notches 31. Two second springs 16 are positioned between the engaging blocks 15 and the blade seat 11. The second springs 16 serve to resiliently push the engaging block 15 and make the projecting sections 151 thereof inserted into the engaging notches 31 to engage with the blade 3. When the blade seat 11 is slided forward, the blade 3 is driven to extend out of the main body 1 from the exit 10 at front end of the main body 1. The main body 1 has a guide rail 17 corresponding to the engaging block 15. Referring to FIG. 3, the guide rail 17 is disposed at a position slightly higher than the blade 3. The front section of the guide rail 17 is a slope section 171. By means of the guiding of the slope section 171, in the travel of the blade 3 pushed out by the blade seat 11, the second springs 16 push the engaging block 15 and make the projecting sections 151 thereof inserted into the engaging notches 31 of the blade 3 deeper and deeper until the projecting sections 151 totally pass through the engaging notches 31. At this time, the engaging block 15 is firmly engaged with the blade 3. When returned, the blade seat 11 is restricted by the guide rail 17 so that the depth by which the projecting sections 151 are inserted in the engaging notches 31 is gradually reduced until it is slightly smaller than the thickness A of the blade 3.

The main body 1 is provided with a press button 18 disposed at a position where the engaging block 15 is positioned when the blade seat 11 is moved forward to extend the blade 3 out of the main body 1. When the press button 18 is pressed, the engaging block 15 is pushed to make the projecting sections 151 disengaged from the engaging notches 31 of the blade 3. Under such circumstance, the blade 3 can be drawn out of the main body 1.

A handle 19 is pivotally connected with rear end of the main body 1. The handle 19 is formed with a chamber 191 for receiving spare blades 3 therein. The handle 19 has a hook section 192 and the main body 1 has a locking member 101 for hooking the hook section 192 to lock the handle 19 with the main body 1. After pressed, the locking member 101 compresses a third spring 102 and disengages from the hook section 192. At this time, the handle 19 can be pivotally rotated to open the chamber 191 for taking out a spare blade 3.

Figure 6:
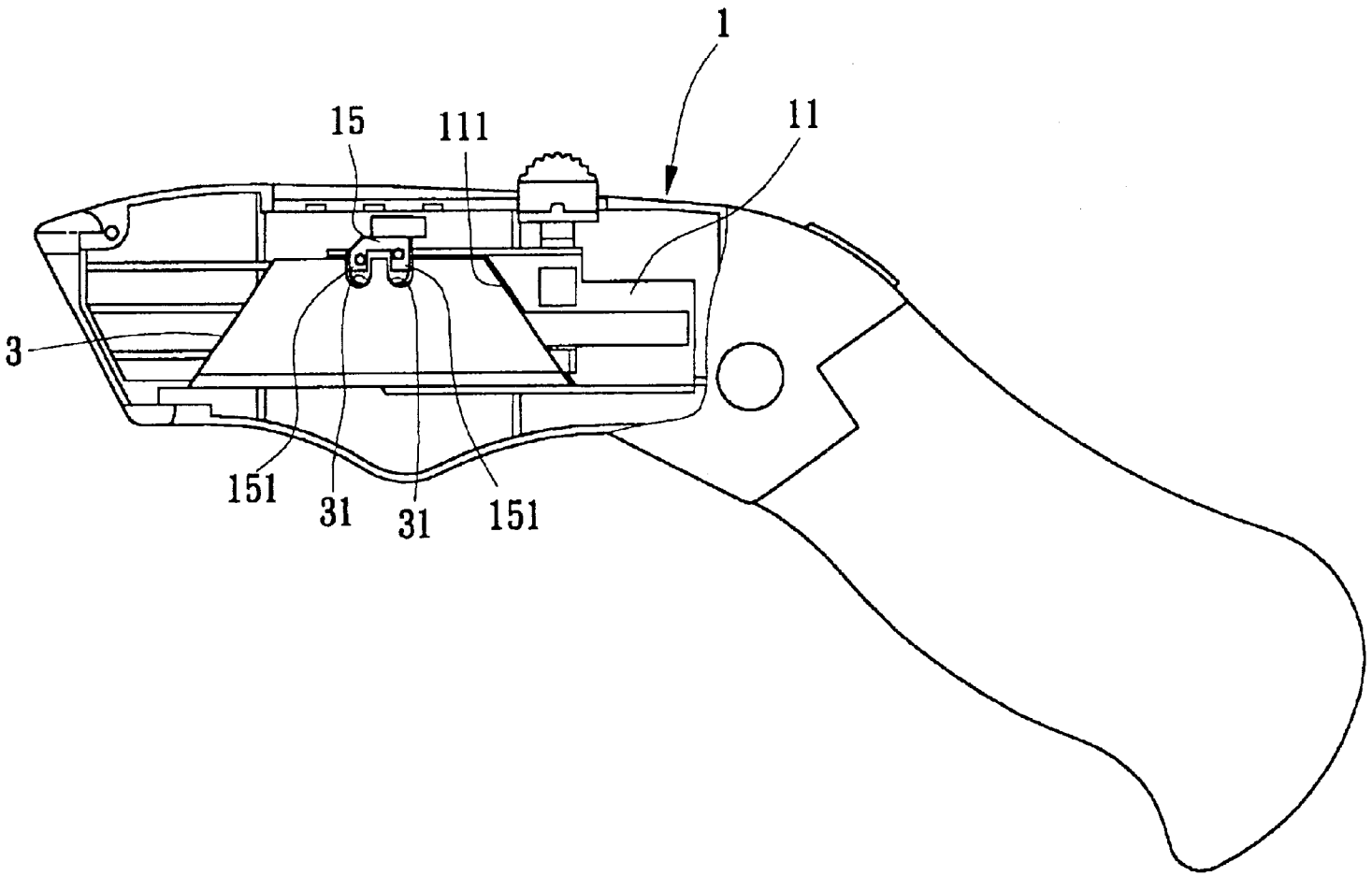
FIG. 6 is a sectional view taken along line VI—VI of FIG. 1.
Figure 7A:
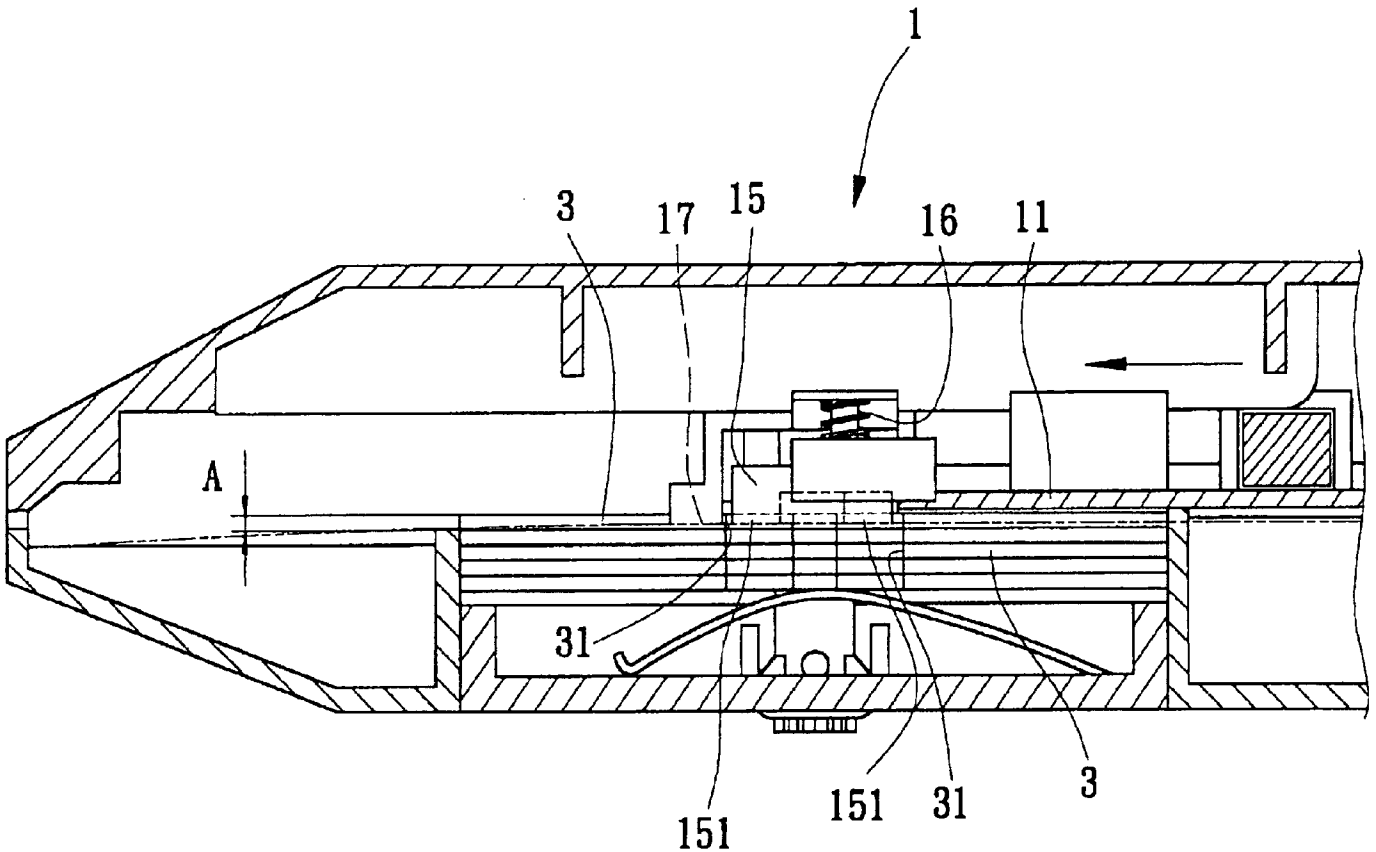
FIG. 7A shows that the guide rail of the present invention restricts the engaging block from engaging with the blade.
Figure 7B:
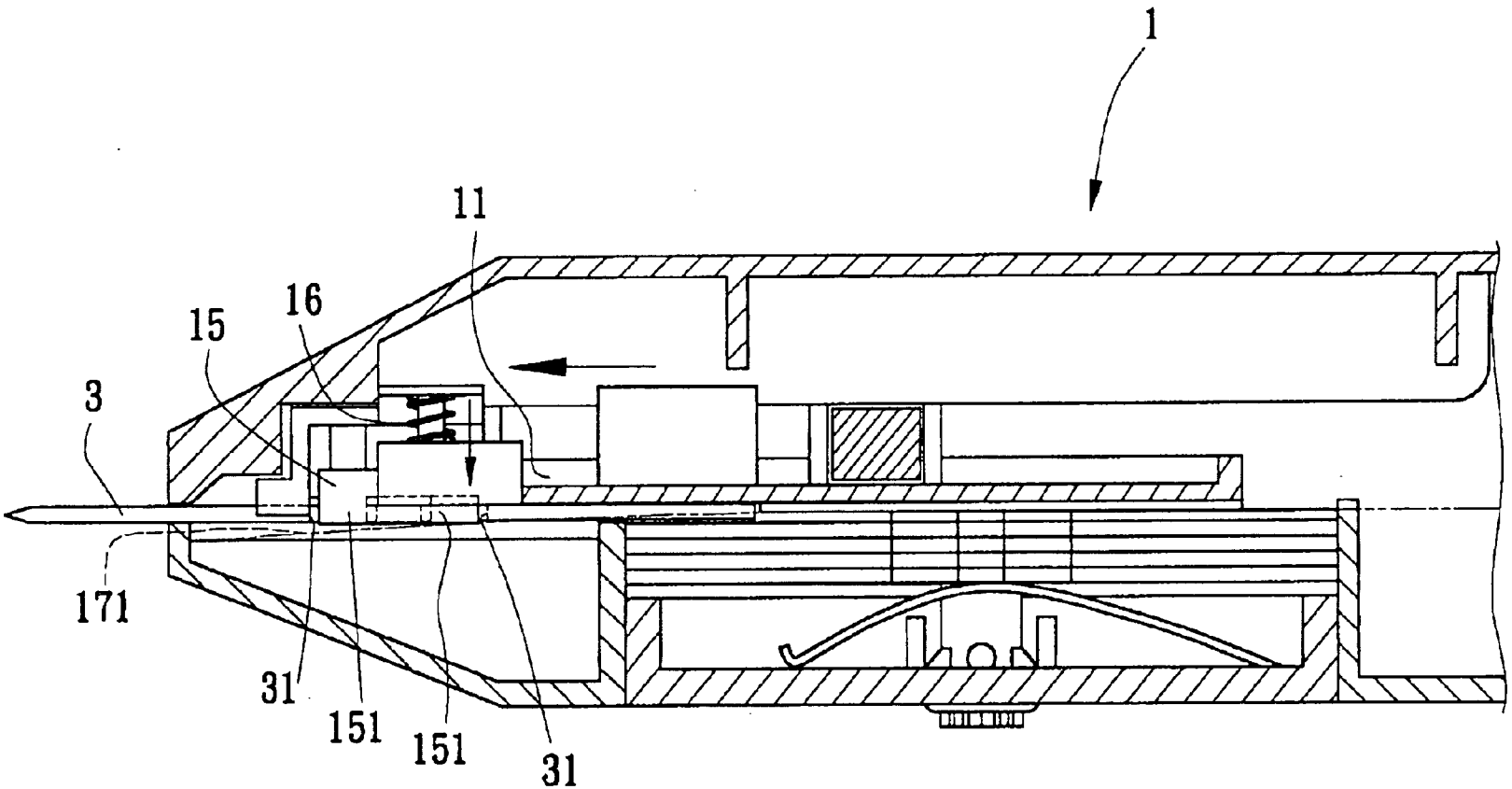
FIG. 7B shows that the guide rail of the present invention guides the engaging block to engage with the blade.

Referring to FIG. 6, when the blade seat 11 is positioned at a rear location, the blade cavity 111 of the blade seat 11 is aligned with the receptacle 13. At this time, the blades 3 loaded in the receptacle 13 are pushed by the resilient member 142 of the cover 14 and the blade 3 closest to the blade seat 11 will fall into the blade cavity 111 with the projecting sections 151 of the engaging block 15 engaged in the engaging notches 31. At this time, the engaging block 15 is restricted by the guide rail 17 so that the depth by which the projecting sections 151 are inserted in the engaging notches 31 of the blade 3 is slightly shorter than the thickness A of the blade 3 as shown in FIG. 7A. Accordingly, it will not take place that the engaging block 15 is at the same time engaged with two blades. When a user presses and pushes the push button 21 forward, the blade seat 11 is driven to move forward. At this time, the engaging block 15 will synchronously drive the blade 3 to move forward and extend out of the exit 10 of the main body 1. When the engaging block 15 moves to the slope section 171 of the guide rail 17 along with the blade seat 11, the slope section 171 guides the engaging block 15 and the second springs 16 push the engaging block 15. Accordingly, the projecting sections 151 of the engaging block 15 are inserted into the engaging notches 31 of the blade 3 deeper and deeper. Finally, the engaging block 15 is totally inserted in the engaging notches 31 as shown in FIG. 7B. At this time, the engaging block 15 is truly engaged with the blade 3 which will not detach from the engaging block 15 in use.

Figure 8:
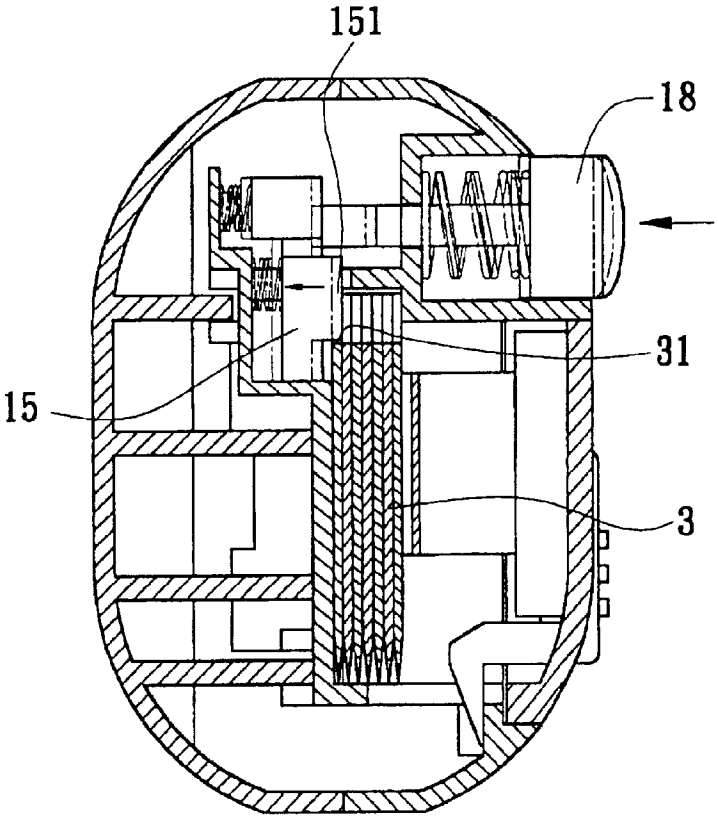
FIG. 8 shows that the press button of the present invention abuts against the engaging block.
Figure 9:
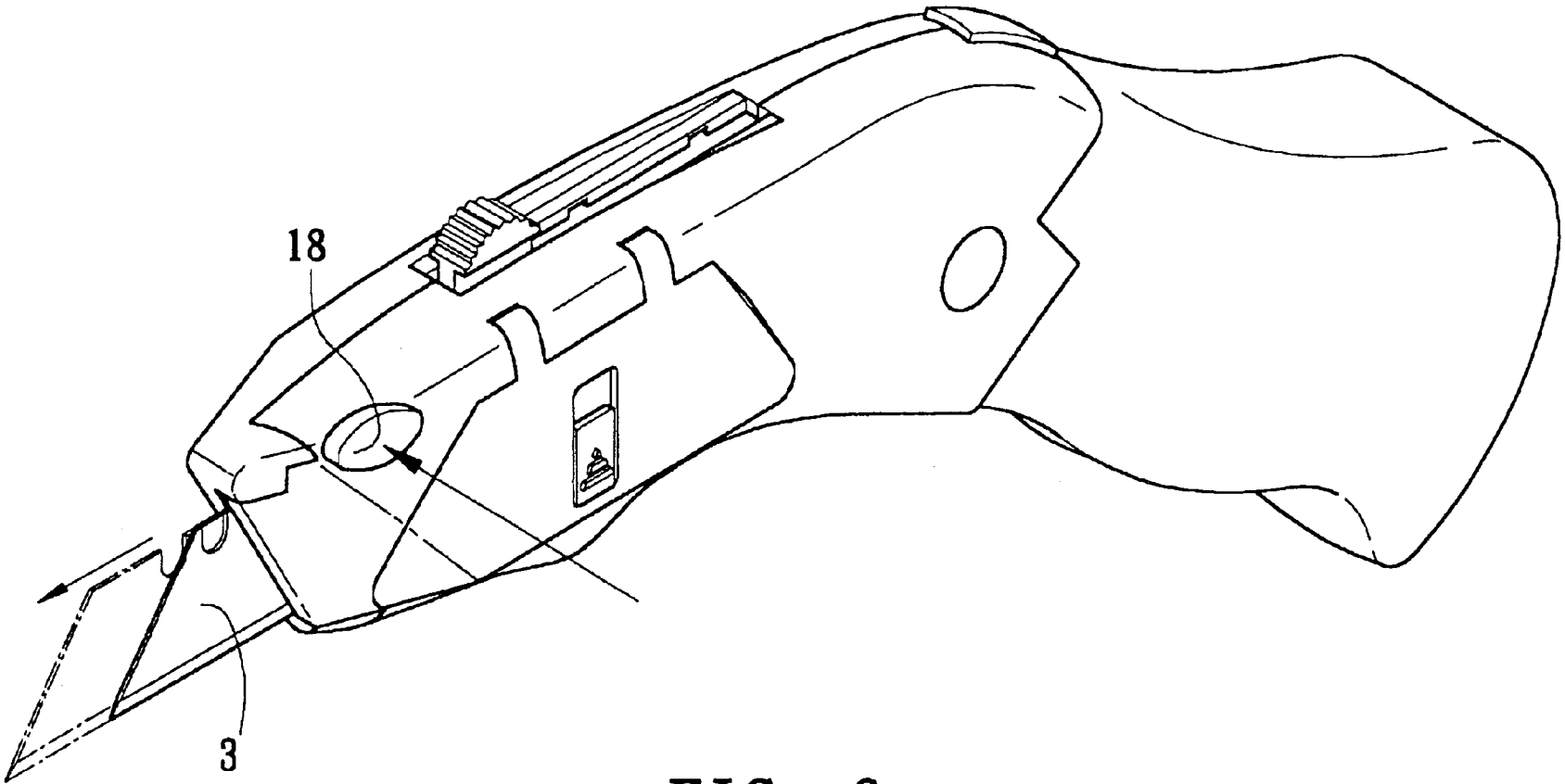
FIG. 9 shows that the press button is pressed for taking out the blade.

When replacing the blade 3, the blade 3 is first pushed to extend out of the exit 10 and then the press button 18 is pressed as shown in FIGS. 8 and 9. At this time, the press button 18 will abut against the engaging block 15 to disengage the projecting sections 151 from the engaging notches 31 of the blade 3. Under such circumstance, the blade 3 can be drawn out as shown in FIG. 9. After the blade seat 11 is moved backward, a new blade 3 in the receptacle 13 can be supplemented into the blade cavity 111.

Figure 10:
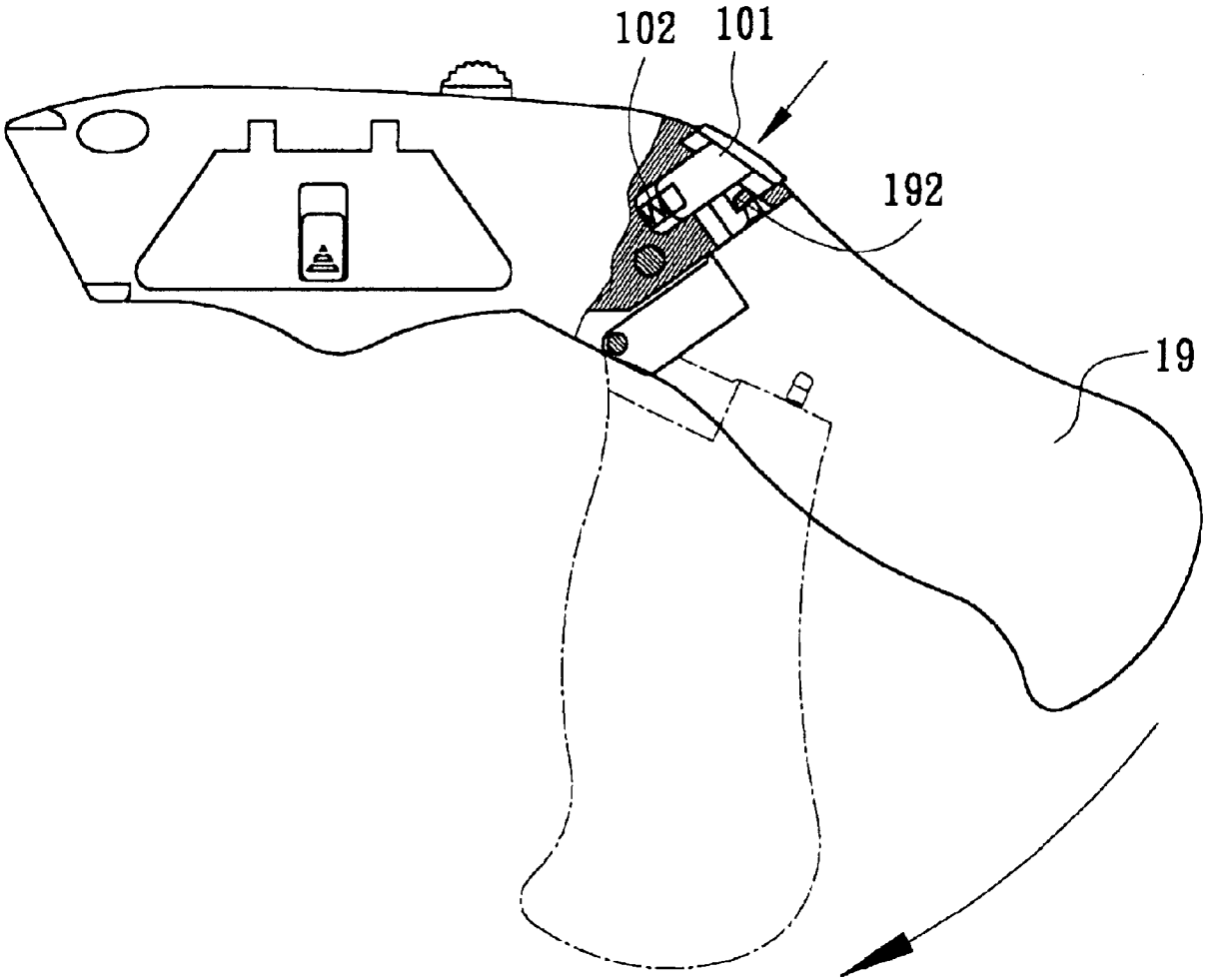
FIG. 10 shows that the locking member is pressed for rotating the handle.
Figure 11:
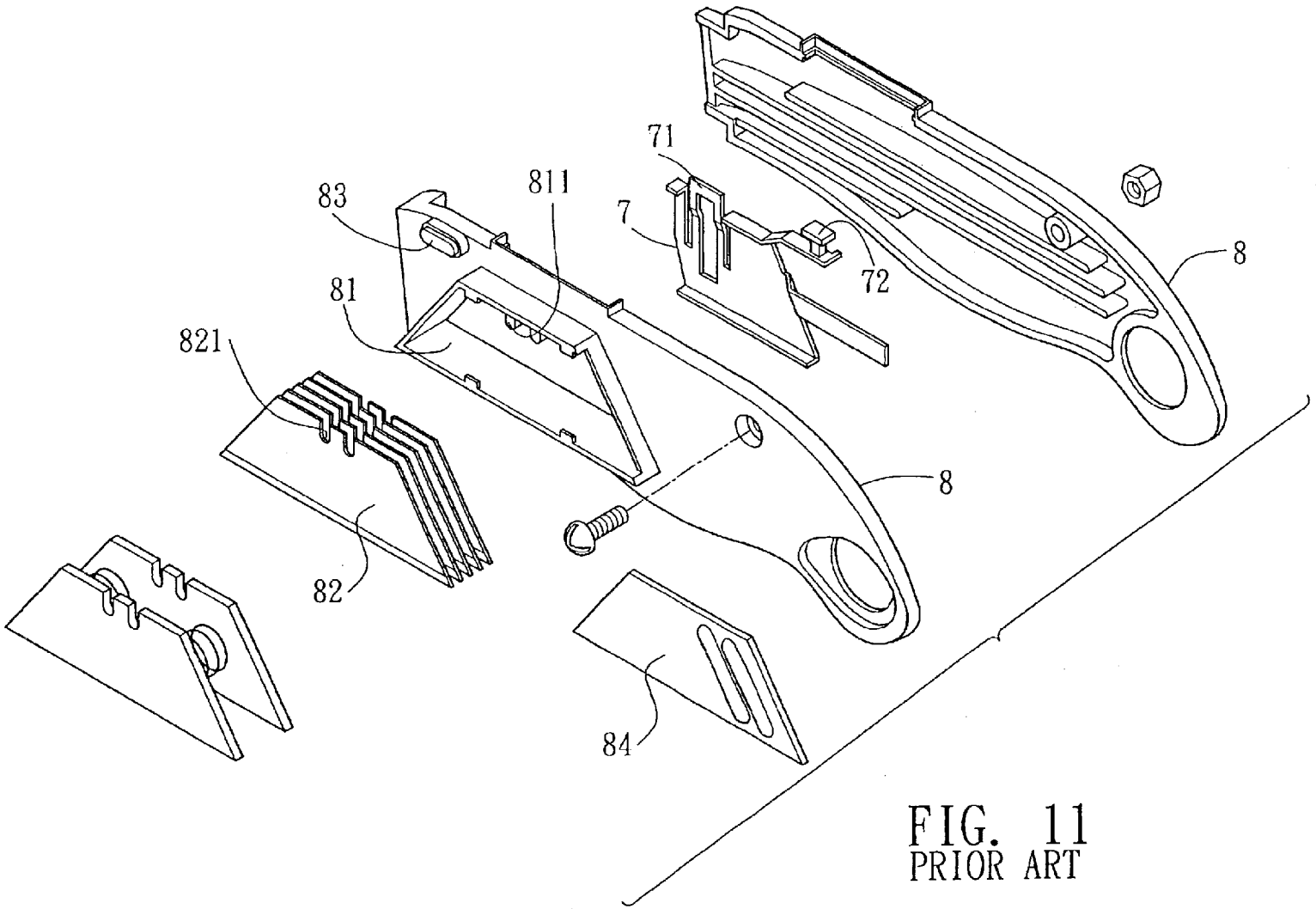
FIG. 11 PRIOR ART
FIGS. 11 is a perspective exploded view of a conventional artistic knife with spare blades.
Figure 12:
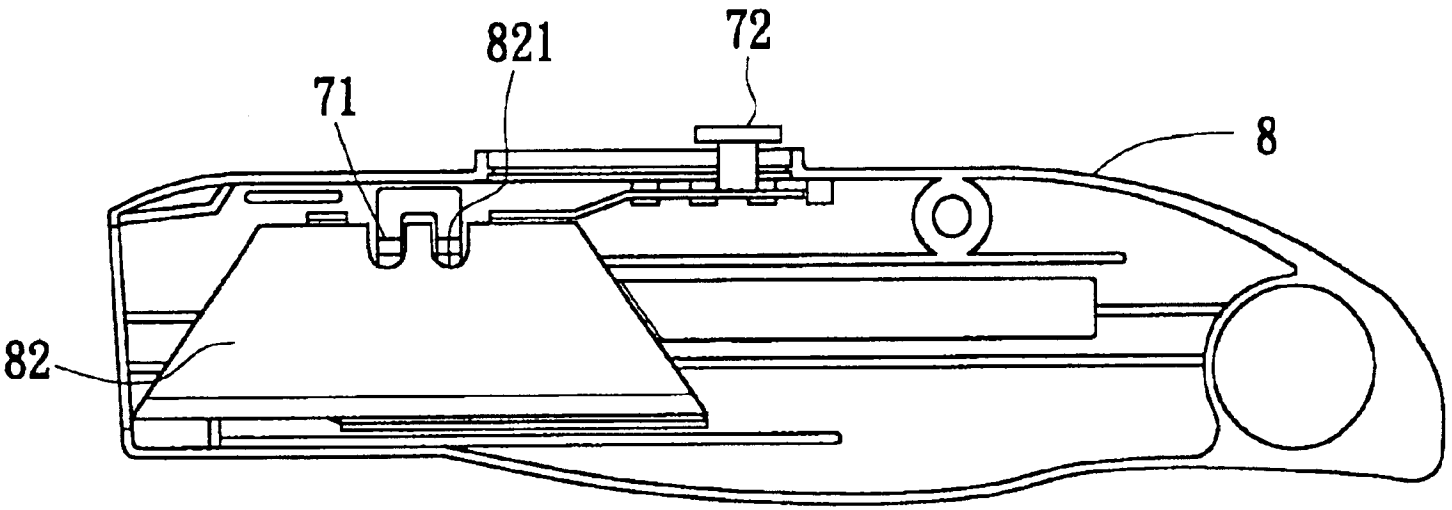
PRIOR ART FIG. 12
FIG. 12 is a plane assembled view of the inner side of the conventional artistic knife with spare blades.
Figure 13:
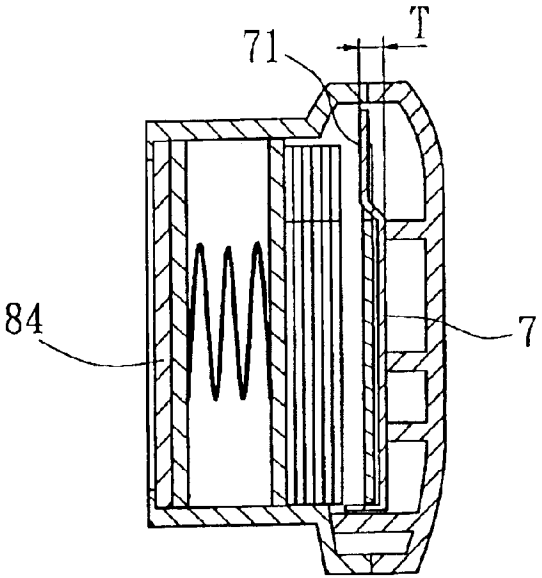
FIG. 13 PRIOR ART
FIG. 13 is a sectional view of the conventional artistic knife with spare blades, showing the structure of the blade and blade seat thereof.

When taking the spare blade 3 in the handle 19, the user first presses the locking member 101 of the main body 1 to compress the third spring 102 and unlock the locking member 101 from the hook section 192. At this time, the handle 19 can be rotated to open the chamber 191. Accordingly, the spare blade 3 can be taken out as shown in FIG. 10.

According to the above arrangement, the present invention has the following advantages:

1. By means of the guiding of the slope section 171 and the restriction of the guide rail 17, in the travel of the blade 3 pushed out by the blade seat 11, the engaging block 15 is pushed by the second springs 16 to make the projecting sections 151 inserted into the engaging notches 31 of the blade 3 deeper and deeper. Therefore, the blade 3 can be truly engaged. In returning travel, under restriction of the guide rail 17, the depth by which the projecting sections 151 of the engaging block 15 are inserted in the engaging notches 31 of the blade 3 is gradually reduced until it is slightly smaller than the thickness A of the blade 3. Therefore, only one single blade 3 is truly engaged.
2. The blade seat 11 has a slot 112 rearward extending from the blade cavity 111. In addition, the receptacle 13 has a projecting block 133 corresponding to the slot 112. The projecting block 133 is inlaid in the slot 112 for stopping the blade 3 when the blade seat 11 is moved backward. Accordingly, the blade 3 is prevented from sliding backward along with the blade seat 11 and getting out of the receptacle 13.
3. The handle 19 is pivotally connected with rear end of the main body 1. The handle 19 is formed with a chamber 191 for receiving spare blades 3 therein. Accordingly, the number of the spare blades 3 is increased.

The above embodiment is only used to illustrate the present invention, not intended to limit the scope thereof. Many modifications of the above embodiment can be made without departing from the spirit of the present invention.

What is claimed is:

1. An artistic knife with spare blades, comprising a main body in which a blade seat is reciprocally slidably moved, a receptacle defined in the main body and corresponding to the blade seat for receiving multiple spare blades, each blade having more than one engaging notch defined therein, a locating section inward extending from a periphery of the receptacle and corresponding to the engaging notch of the blade for restricting moving direction of the blade, an engaging block laterally mounted to the blade seat and engaged to the engaging notch of the blade such that the blade is driven to extend out of an exit at front end of the main body when the blade seat is moved toward the front end of the main body, a press button laterally mounted to the main body for pushing the engaging block to disengage from the engaging notch of the blade, whereby the blade can be drawn out and replaced, wherein the improvement comprises:

the blade seat formed with a blade cavity for receiving a blade therein, blade cavity having a depth being slightly shorter than the thickness of the blade, the blade seat having a slot rearward extending from the blade cavity, the receptacle having a projecting block corresponding to the slot, whereby the projecting block serves to stop and prevent the blade from sliding backward along with the blade seat;

the engaging block transversely movably disposed on the blade seat, more than one spring springs being positioned between the engaging block and the blade seat for pushing the engaging block to insert into the engaging notch of the blade, the main body having a guide rail corresponding to the engaging block, a slope section formed on a front section of the guide rail, in a travel of the blade pushed out by the blade seat, the engaging block pushed by the springs and inserted into the engaging notches of the blade deeper and deeper and in returning travel due to the slope section of the guide rail, under restriction of the guide rail, a depth by which the engaging block is inserted in the engaging notch of the blade gradually reduced until it being slightly smaller than a thickness of the blade; and a push member partially inserted into the blade seat for reciprocally driving the blade seat, a slot defined in a top portion of the main body and extending through the main body, the push member including a top end extending through the main body via a slot that is defined in a top portion of the main body, a push button formed on the top end of the push member for user to reciprocally drive the blade seat in the main body, a spring mounted between the blade seat and the push button for upwardly pushing the push button, the slot in the main body including two opposite sides each having a bottom edge formed with multiple engaging recessed and the push button including two opposite sides each having a projections formed thereon and corresponding to each other, each projection received in a corresponding one of the multiple engaging recesses for selectively hold the push member in place.

2. The artistic knife with spare blades as claimed in claim 1, wherein a handle is pivotally connected with the main body, the handle being formed with a chamber for receiving spare blades therein, the handle having a hook section and the main body having a locking member for hooking the hook section to lock the handle with the main body.

3. The artistic knife with spare blades as claimed in claim 1, wherein one side of the receptacle has an opening passing through the main body opposite to the blade seat, a cover being pivotally disposed at the opening for covering the opening in the receptacle, the cover having an inward projecting resilient member for resiliently pushing the blade to abut against the blade seat.

* * * * *